US007658369B2

(12) United States Patent
Baldwin

(10) Patent No.: US 7,658,369 B2
(45) Date of Patent: Feb. 9, 2010

(54) POST PULLING DEVICE

(76) Inventor: Matthew B Baldwin, 424 Church St., West Union, WV (US) 26456

( * ) Notice: Subject to any disclaimer, the term of this patent is extended or adjusted under 35 U.S.C. 154(b) by 331 days.

(21) Appl. No.: 11/620,929

(22) Filed: Jan. 8, 2007

(65) Prior Publication Data

US 2008/0164446 A1 Jul. 10, 2008

(51) Int. Cl.
*E21B 19/00* (2006.01)

(52) U.S. Cl. ..... 254/30; 254/131; 254/134

(58) Field of Classification Search ..... 254/30, 254/131, 133 R, 134, 420
See application file for complete search history.

(56) References Cited

U.S. PATENT DOCUMENTS

| | | | | | |
|---|---|---|---|---|---|
| 1,392,885 | A | * | 10/1921 | Battelle | 254/131 |
| 1,458,530 | A | * | 6/1923 | Hilton | 254/130 |
| 2,010,680 | A | * | 8/1935 | Van Leuven | 254/131 |
| 2,960,309 | A | * | 11/1960 | Swanson | 254/133 R |
| 4,334,669 | A | * | 6/1982 | Ross | 254/130 |
| 4,660,806 | A | * | 4/1987 | Masters | 254/11 |
| 4,738,433 | A | | 4/1988 | Hoff | |
| 5,022,632 | A | * | 6/1991 | Beideck | 254/30 |
| 5,186,437 | A | | 2/1993 | Scott | |
| 5,775,674 | A | * | 7/1998 | Bigham | 254/131 |
| 5,833,215 | A | | 11/1998 | Vandenburg | |
| 5,934,649 | A | * | 8/1999 | Drane | 254/30 |
| 6,170,803 | B1 | * | 1/2001 | Liberfarb | 254/131 |
| 6,409,151 | B1 | * | 6/2002 | Cormier | 254/8 R |
| 6,431,524 | B1 | * | 8/2002 | Weber | 254/134.3 FT |
| 6,968,878 | B2 | * | 11/2005 | Smith | 144/34.2 |
| 7,370,844 | B2 | * | 5/2008 | McGriff | 254/420 |
| 2008/0164446 | A1 | * | 7/2008 | Baldwin | 254/30 |

* cited by examiner

*Primary Examiner*—Lee D Wilson
(74) *Attorney, Agent, or Firm*—Dale J. Ream

(57) ABSTRACT

A post pulling device includes a tower having first and second side members, each side member having a plurality of receiving slots. Each receiving slot of the first side member corresponds to a respective receiving slot of the second side member. The post pulling device includes a rigid bar having opposed first and second ends, opposed first and second sides, and first and second pivoting members extending from the first and second sides, respectively. The first and second pivoting members are respectively receivable in corresponding receiving slots of the first and second side members. An end plate and a lanyard are included for coupling a post to the first end of the rigid bar. A hitch element may be coupled to the tower for selectively coupling the tower to a vehicle hitch. The rigid bar may be telescopic with structures for maintaining the rigid bar at a selected length.

16 Claims, 6 Drawing Sheets

POST PULLING DEVICE

BACKGROUND OF THE INVENTION

This invention relates generally to post pulling devices and, more particularly, to a post pulling device that is adjustable to accommodate multiple usage situations and that may be selectively secured by a user's foot or to a receiver attachment of an all-terrain vehicle.

Fence posts frequently need to be removed from their ground position, such as for repair, replacement, or just to clear an area of all obstructions. Common difficulties with this process of post removal include obtaining enough leverage to completely remove the post and to do so without breaking it. This is especially a problem when removing round wooden posts. It may be desirable to both place and pull posts as part of a landscaping project.

Various devices have been proposed for pulling posts out of the ground, especially devices for pulling metal posts. Although assumably effective for their intended purposes, the existing devices do not provide enough leverage (or properly distributed leverage) to pull the posts effectively. Further, the existing devices are not adjustable for various pulling situations and are not selectively stabilized by a user's foot or by attachment to an all-terrain vehicle.

Therefore, it would be desirable to have a post pulling device that can attach to a post so as to pull the post effectively and efficiently without damaging it. Further, it would be desirable to have a post pulling device that is adjustable for multiple usage situations. In addition, it would be desirable to have a post pulling device that may be stabilized by a user's foot for manual operation or by attachment to an all-terrain vehicle.

SUMMARY OF THE INVENTION

A post pulling device according to the present invention includes a tower having first and second side members with each side member having a plurality of receiving slots. Each receiving slot of the first side member corresponds to a respective receiving slot of the second side member. The post pulling device includes a rigid bar having opposed first and second ends, opposed first and second sides, a first pivoting member extending from the first side and a second pivoting member extending from the second side. The first and second pivoting members are respectively receivable in corresponding receiving slots of the first and second side members. An end plate and a lanyard are included for efficiently coupling a post to the first end of the rigid bar. Further, a hitch element may be coupled to the tower for selectively coupling the tower to a vehicle hitch. The rigid bar may be telescopic with structures for maintaining the rigid bar at a plurality of lengths.

Therefore, a general object of this invention is to provide a post pulling device for removing posts from the ground, whether the posts are round, square, or have uneven surfaces.

Another object of this invention is to provide a post pulling device, as aforesaid, that is adjustable for multiple post pulling situations, such as landscaping, clearing the land for another use, or for replacement of posts.

Still another object of this invention is to provide a post pulling device, as aforesaid, that may be manually stabilized by a user's foot or removably coupled to a receiver hitch of an all-terrain vehicle.

Yet another object of this invention is to provide a post pulling device, as aforesaid, that can pull soft posts, such as those made of wood, without damaging them.

A further object of this invention is to provide a post pulling device, as aforesaid, that may be manufactured economically.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
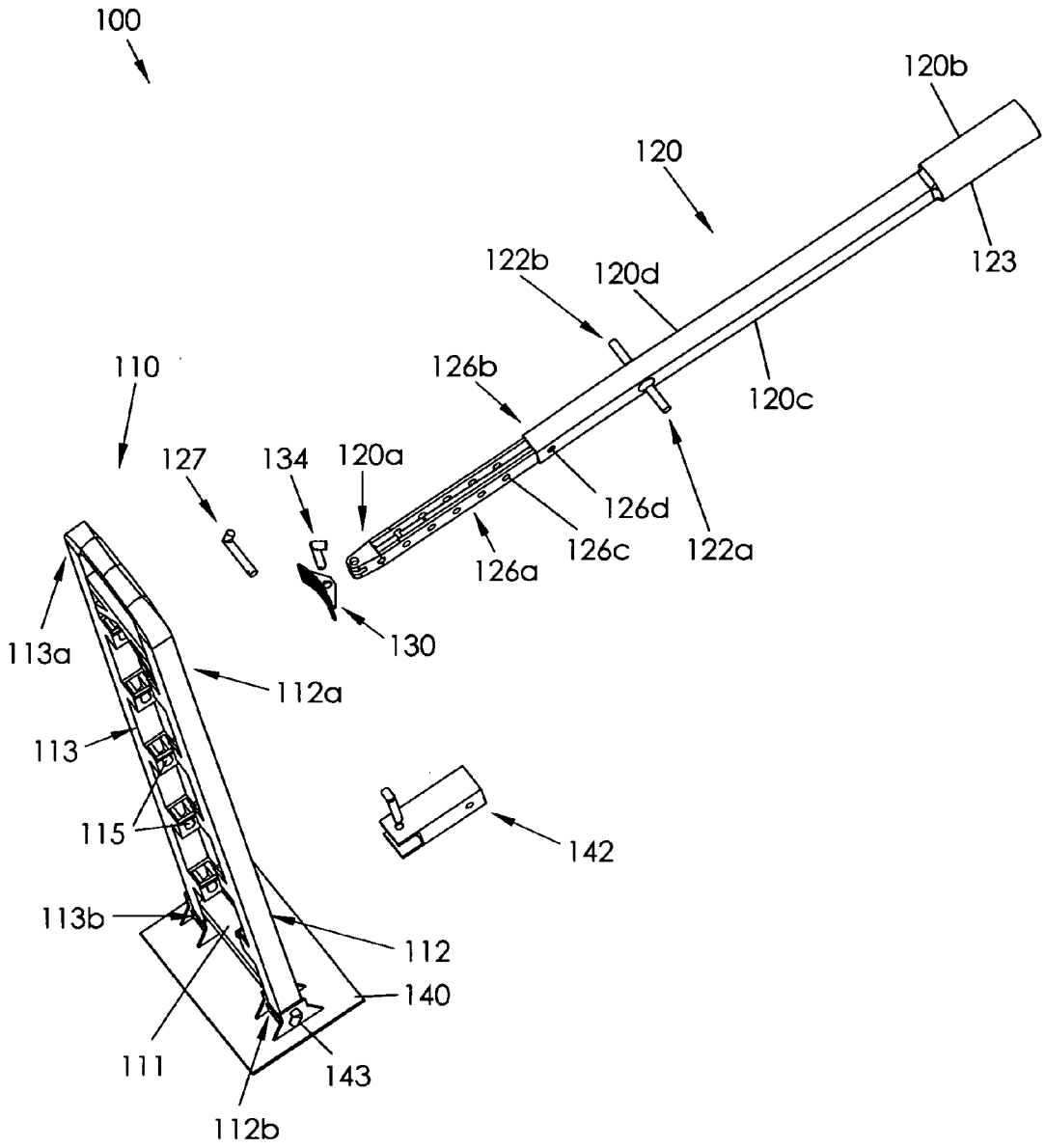
FIG. 1 is an exploded view of a post pulling device according to a preferred embodiment of the present invention.

A post pulling device 100 according to the present invention will now be described in detail with reference to FIGS. 1 through 6*c* of the accompanying drawings. More particularly, a post pulling device 100 according to the current invention includes a tower 110 and a rigid bar 120.

The tower 110 has opposed first and second side members 112, 113 spaced a predetermined distance apart. At least one cross member 111 may connect the first and second side members 112, 113 and maintain the predetermined distance between the first and second side members 112, 113. Each respective side member 112, 113 has upper and lower ends 112*a*, 112*b*, 113*a*, 113*b*, and a plurality of coated bearing surfaces 115 are spaced apart between the upper and lower ends 112*a*, 112*b*, 113*a*, 113*b*. Each bearing surface 115 of the first side member 112 may correspond to a bearing surface 115 of the second side member 113, or in other words, the bearing surfaces 115 of the first and second side members 112, 113 may be at substantially the same height when the tower 110 is positioned upright. It should be understood that each bearing surface 115 may be coated with a material such as polytetrafluoroethylene (a.k.a. Teflon®) or other suitable substance that has friction properties enabling unhindered movement or rotation.

As shown in FIG. 1, the rigid bar 120 has opposed first and second ends 120*a*, 120*b* and opposed first and second sides, 120*c*, 120*d*. A first pivoting member 122*a* extends from the first side 120*c*, and a second pivoting member 122*b* extends from the second side 120*d*. Each respective pivoting member 122*a*, 122*b* may be cylindrical and may extend generally perpendicular to the rigid bar 120. The rigid bar second end 120*b* may include a handle 123 as shown in FIGS. 1 through 3*b*, and the rigid bar 120 may be telescopic. More particularly, the rigid bar 120 may include inner and outer members 126*a*, 126*b* and means for selectively maintaining the rigid bar 120 at a plurality of lengths (i.e., maintaining the inner and outer members 126*a*, 126*b* in different positions relative to one another). A pin 127 (FIG. 1) may pass through holes 126*c*, 126*d* in the inner and outer members 126*a*, 126*b* to couple the inner and outer members 126*a*, 126*b* together, or other coupling devices (e.g., clamps, spring activated pins, etc.) may be used.

Figure 2:
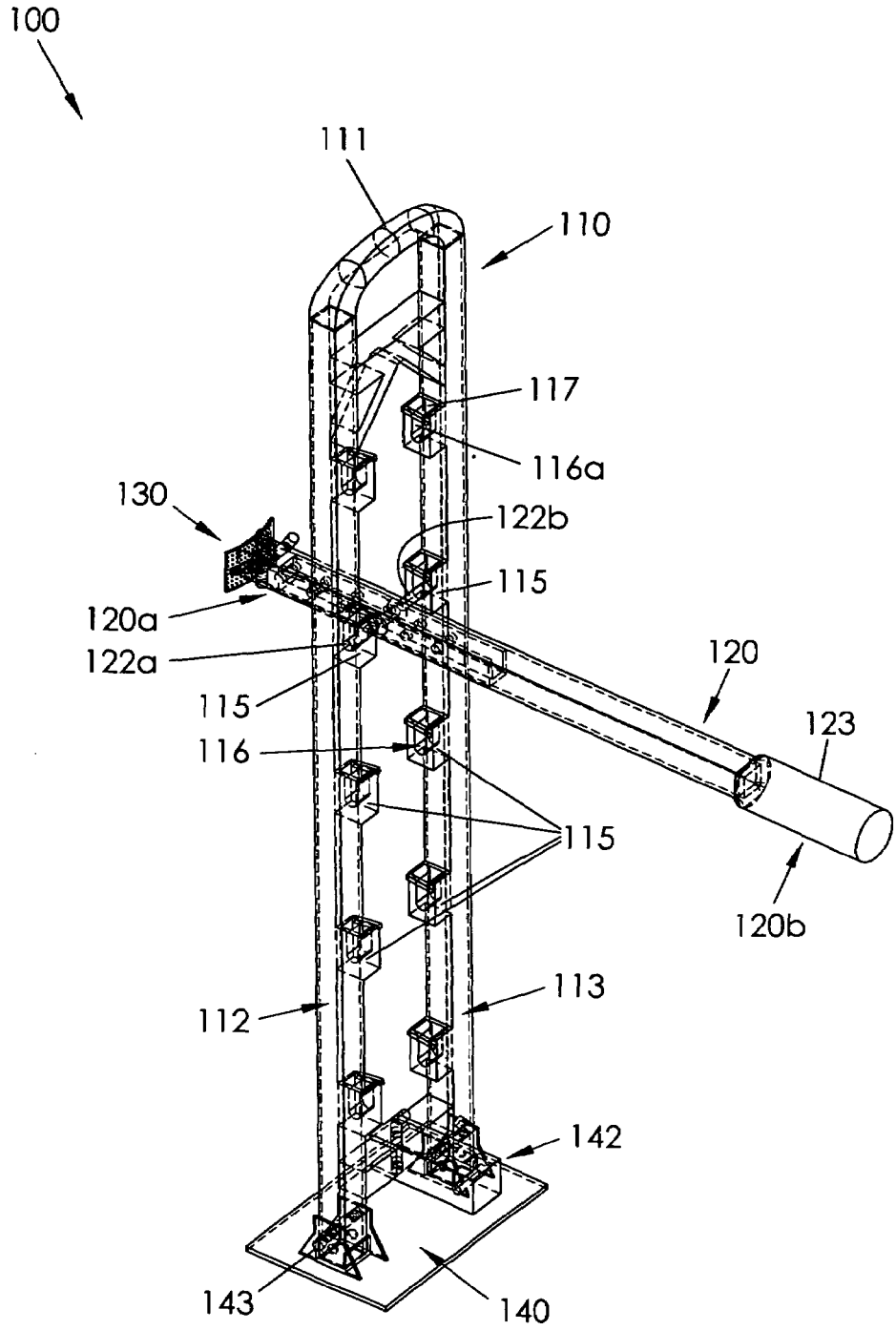
FIG. 2 is a perspective view of the post pulling device as in FIG. 1.
Figure 3A:
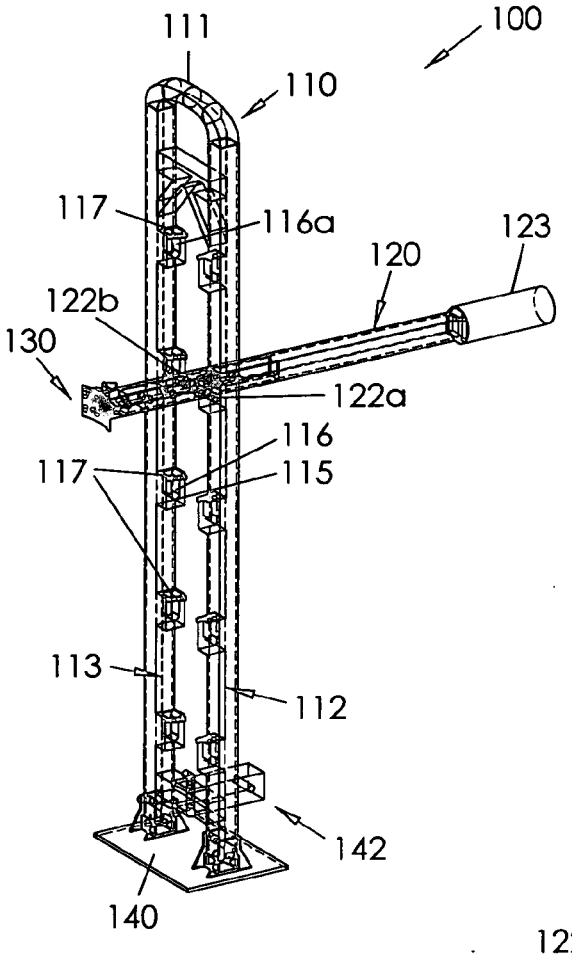
FIG. 3*a* is another perspective view of the post pulling device as in FIG. 2 with a rigid bar in a retracted configuration.
Figure 3B:
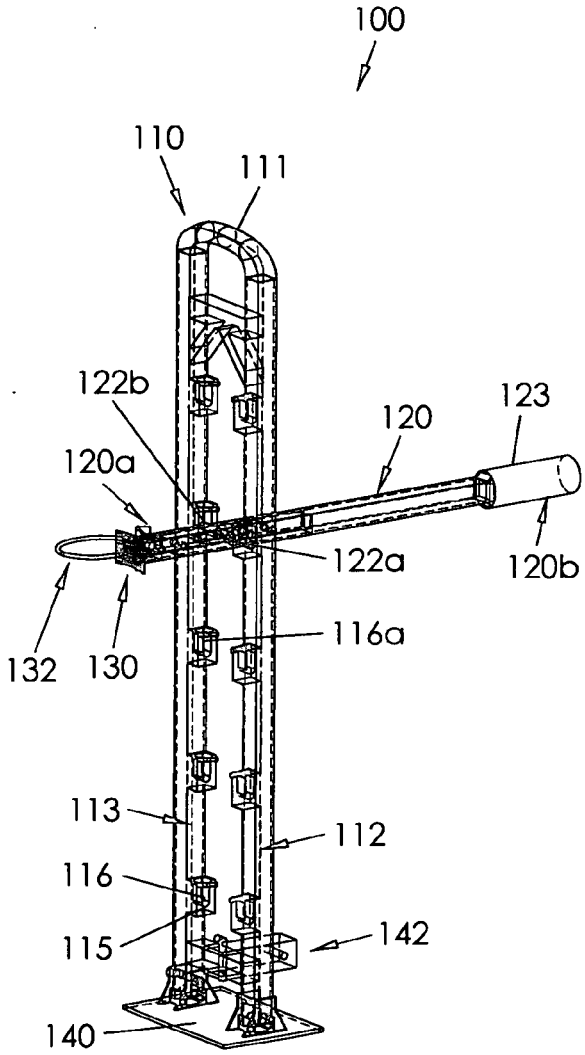
FIG. 3*b* is a perspective view of the post pulling device as in FIG. 3*a* with the rigid bar in an extended configuration.

As shown in FIGS. 1 through 3*b*, the bearing surfaces 115 may be defined by receiving slots 116, and the first and second pivoting members 122*a*, 122*b* may be respectively received in the corresponding receiving slots 116 (FIGS. 2 through 3*b*) so that the pivoting members 122*a*, 122*b* are supported by the bearing surfaces 115. Importantly, the interactions between the bearing surfaces 115 and the pivoting members 122*a*, 122*b* allow the rigid bar 120 to rotate relative to the tower 110. To aid this rotation, the bearing surfaces 115 (i.e., the bottom of the receiving slots 116) may be rounded, "v" shaped, or any other suitable configuration. Each receiving slot 116 may include an open top 116*a* for receiving a respective pivoting member 122*a*, 122*b*, and means for selectively closing each receiving slot open top 116*a* may be included. More particularly, covers 117 may slidably engage the receiving slots 116 as shown in FIGS. 2 through 3*b*, or other latching elements may removably, slidably, or pivotally engage the receiving slots 116.

Figure 4A:
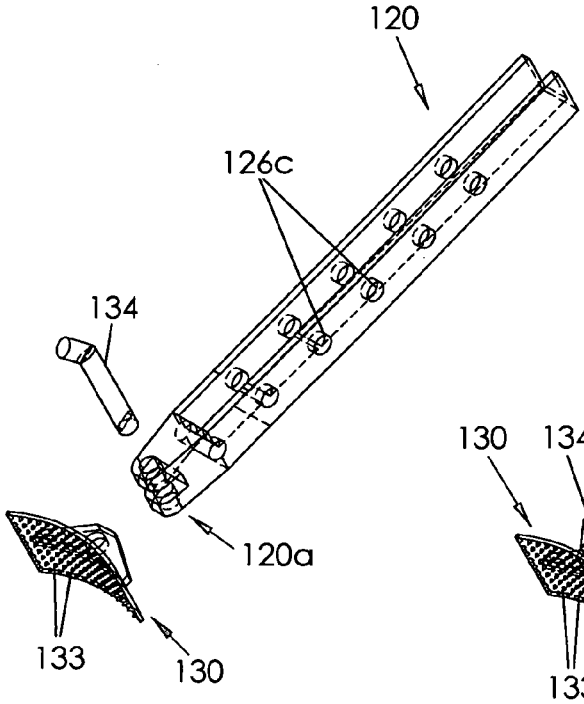
FIG. 4*a* is an isolated and exploded view of the rigid bar as in FIG. 3*a;*
Figure 4B:
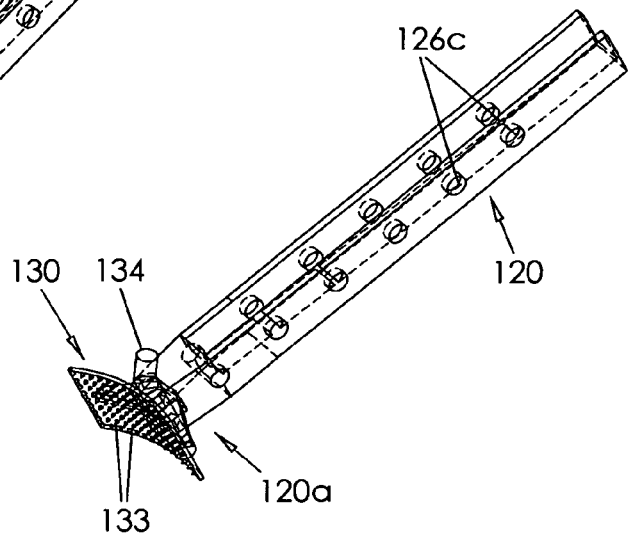
FIG. 4*b* is an isolated perspective view of the rigid bar as in FIG. 4*a;*
Figure 5A:
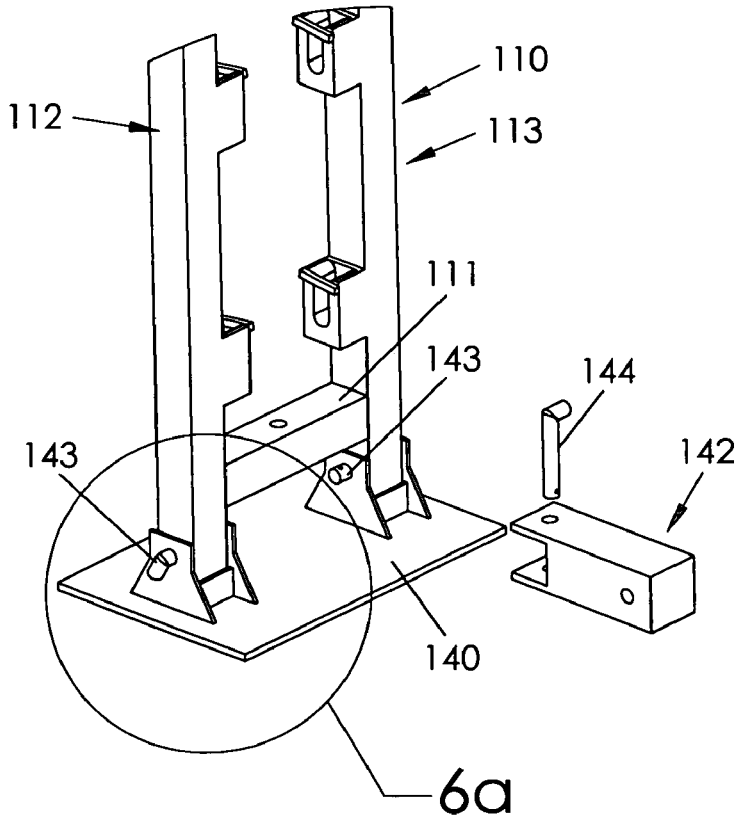
FIG. 5*a* is a fragmentary view of a tower of the post pulling device as in FIG. 2 with a hitch element detached from a cross member of the tower.
Figure 5B:
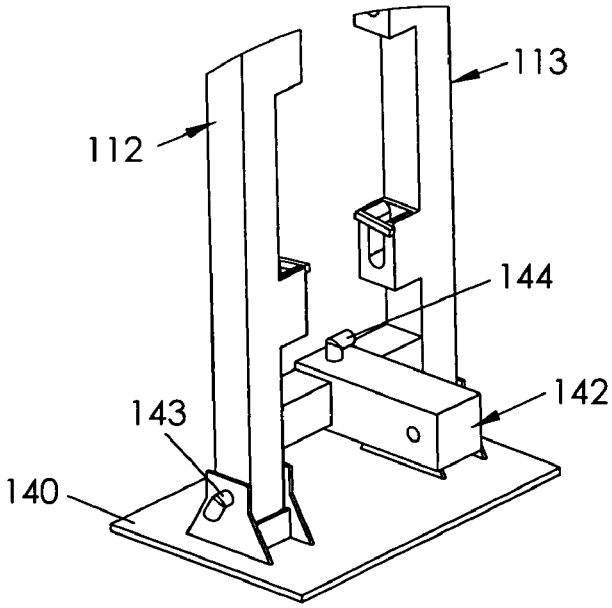
FIG. 5*b* is perspective view as in FIG. 5*a* with the hitch element coupled to the cross member.
Figure 6A:
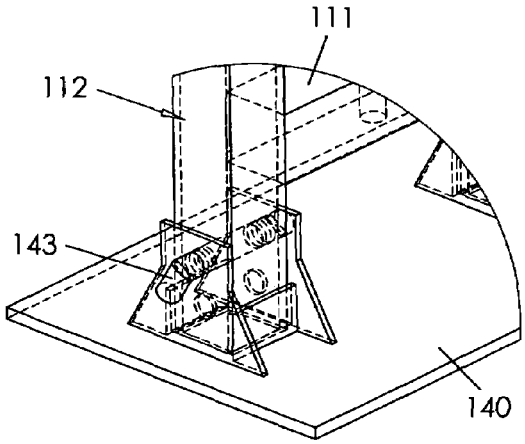
FIG. 6*a* to 6*c* illustrate that the bottom plate is pivotally coupled to the first and second side members of the tower and may be selectively positioned relative thereto.
Figure 6B:
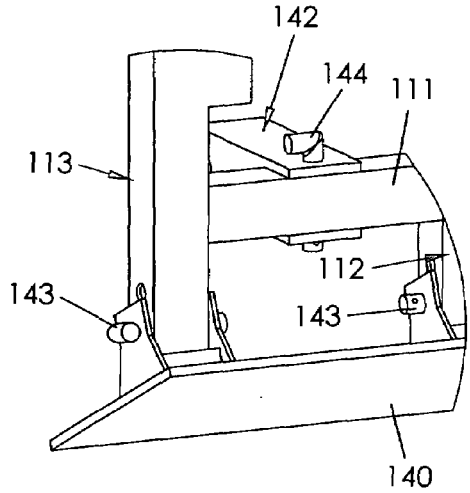
Figure 6C:
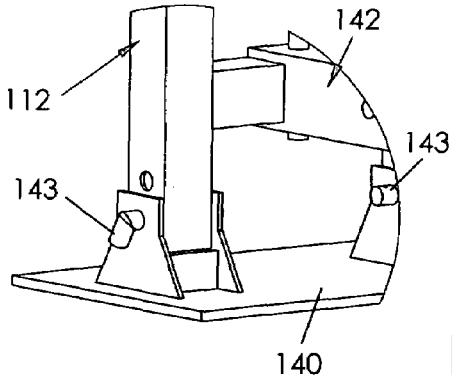

Means for coupling a post (not shown) to the rigid bar first end 120*a* may be included. More particularly, an end plate 130 and a lanyard 132 may be coupled to the rigid bar first end 120*a*. The end plate 130 may be curved away from the rigid bar second end 120*b*, and as shown in FIGS. 4*a* and 4*b*, the end plate 130 may include a plurality of spikes 133 extending away from the rigid bar second end 120*b*. Of course, the end plate 135 may also be flat/uncurved The end plate 130 may be pivotable toward the rigid bar first side 120*c* and the rigid bar second side 120*d*. For example, a pin 134 (FIGS. 4*a* and 4*b*) may selectively couple the end plate 130 to the rigid bar 120. Various end plates 130 with different diameters and shapes may be respectively coupled to the rigid bar 120 to match posts of different sizes and shapes, though a single end plate 130 may also be used for different posts. The lanyard is preferably strong, corrosive resistant, and flexible, and materials such as (nonexclusively) steel chain, steel braided cable, and nylon may be used.

Means for stabilizing the tower 110 may be included. More particularly, a bottom plate 140 may be permanently or removably coupled to the first and second side members 112, 113, and/or a hitch element 142 may be permanently or removably coupled to the tower 110. The bottom plate 140 may be rotatably/pivotally coupled to the first and second side members 112, 113 (FIGS. 6*a* through 6*c*), or the bottom plate 140 may be fixedly coupled to the first and second side members 112, 113 (FIGS. 5*a* and 5*b*) at a predetermined angle (e.g., ninety degrees). The bottom plate 140, therefore, may be adjustably positioned according to a slope of a ground surface upon which the post pulling device 100 is desired to be used. As shown in FIGS. 5*a* through 6*c*, pins 143 may couple the bottom plate 140 to the tower 110, and a pin 144 (FIGS. 5*a* and 5*b*) may couple the hitch element 142 to the tower 110. The hitch element 142 may be sized and configured to couple the tower 110 to a vehicle hitch (e.g., an All Terrain Vehicle hitch, a tractor hitch, a truck hitch, etc.).

In use, the tower 110 is positioned adjacent a post to be removed (not shown). At least one of the bottom plate 140 and the hitch element 142 is coupled to the tower 110 as described above to stabilize the tower 110 in an upright position as shown in FIGS. 2 through 3*b*. To fully stabilize the tower 110, a user may step on the bottom plate 140 or couple the hitch element 142 to an ATV hitch, tractor hitch, or truck hitch as described above. The end plate 130 may be coupled to the rigid bar first end 120*a* as described above, and the rigid bar 120 may be telescopically extended as described above to a desired length. The first and second pivoting members 122*a*, 122*b* may be positioned in respective receiving slots 116 and supported by the coated bearing surfaces 115 so that the rigid bar 120 is rotatable relative to the tower 110. To maximize the mechanical advantage gained by using the post pulling device 100, it may be desirable to utilize the receiving slots 116 and bearing surfaces 115 that allow the rigid bar 120 to extend generally perpendicular to the tower 110 when the rigid bar first end 120*a* is coupled to the post, though this need not be the case. The multiple receiving slots 116 and bearing surfaces 115 may also allow users of different heights to comfortably use the post pulling device 100.

The post may abut the end plate 130, and the lanyard may be wrapped around the post, secured to the rigid bar 120, and tightened in a conventional manner. The spikes 133 on the end plate 130 may help couple the post to the end plate 130. Once the post is coupled to the end plate 130, the user may force the second end 120*b* of the rigid bar 120 downward, such as by pressing on the handle 123. As the rigid bar second end 120*b* moves downward, the rigid bar first end 120*a* moves upward, pulling the post out of the ground.

It is understood that while certain forms of this invention have been illustrated and described, it is not limited thereto except insofar as such limitations are included in the following claims and allowable functional equivalents thereof.

The invention claimed is:

1. A post pulling device, comprising:

a tower having opposed first and second side members, each said side member having a plurality of receiving slots, each said receiving slot of said first side member corresponding to a respective receiving slot of said second side member;

a rigid bar having opposed first and second ends, opposed first and second sides, a first pivoting member extending from said first side, and a second pivoting member extending from said second side;

wherein:

each said pivoting member is cylindrical;

each said receiving slot includes a rounded bottom for rotatably supporting a respective pivoting member;

each said receiving slot includes an open top for receiving a respective pivoting member;

means for coupling a post to said rigid bar first end;

wherein said first and second pivoting members are respectively receivable in said corresponding first and second side member receiving slots;

a plurality of covers, each cover having a configuration that is complementary to a configuration of a respective receiving slot for slidable and removable engagement therewith to selectively close a respective open top of a said respective receiving slot; and wherein said rigid bar is telescopic and includes means for selectively maintaining said rigid bar at one of a plurality of lengths.

2. The post pulling device of claim 1, wherein said rigid bar second end includes a handle.

3. The post pulling device of claim 1, further comprising a bottom plate selectively coupled to said first side member and said second side member.

4. The post pulling device of claim 1, further comprising a bottom plate selectively rotatably coupled to said first side member and said second side member.

5. The post pulling device of claim 1, further comprising a hitch element coupled to said tower for selectively coupling said tower to a vehicle hitch.

6. The post pulling device of claim 1, wherein said means for coupling a post to said rigid bar first end include an end plate and a lanyard.

7. The post pulling device of claim 6, wherein:

said end plate is curved away from said rigid bar second end;

said end plate includes a plurality of spikes extending away from said rigid bar second end; and said end plate is pivotable toward said rigid bar first side and said rigid bar second side.

8. The post pulling device of claim 1, wherein said tower includes a cross member connecting said first and second side members and maintaining a predetermined distance between said first and second side members.

9. A post pulling device, comprising:

a tower having opposed first and second side members spaced a predetermined distance apart, each said side member having upper and lower ends and a plurality of coated bearing surfaces spaced apart between said upper and lower ends, each said coated bearing surface of said first side member corresponding to a respective coated bearing surface of said second side member;

a rigid bar having opposed first and second ends, opposed first and second sides, a first pivoting member extending from said first side, and a second pivoting member extending from said second side, said first and second pivoting members being selectively supported by respective said corresponding coated bearing surfaces to allow said rigid bar to rotate relative to said tower;

means for coupling a post to said rigid bar first end;

wherein:

each of said first and second pivoting members includes a cylindrical configuration;

each bearing surface defines a receiving slot having a rounded configuration for supporting respective first and second pivoting members;

each respective slot defines an open top for receiving a respective first and second pivoting member;

said first and second pivoting members extend generally perpendicular to said rigid bar;

said rigid bar is telescopic and includes means for selectively maintaining said rigid bar at a plurality of lengths; and a plurality of covers, each cover having a configuration that is complementary to a configuration of a respective receiving slot for slidable and removable engagement therewith to selectively close a respective open top of a said respective receiving slot.

10. The post pulling device of claim 9, further comprising means for stabilizing said tower.

11. The post pulling device of claim 9, further comprising a bottom plate selectively coupled to said first side member and said second side member.

12. The post pulling device of claim 9, further comprising a bottom plate rotatably coupled to said first side member and said second side member.

13. The post pulling device of claim 9, further comprising a hitch element coupled to said tower for selectively coupling said tower to a vehicle hitch.

14. The post pulling device of claim 9, wherein:

said rigid bar second end includes a handle.

15. The post pulling device of claim 9, wherein said means for coupling a post to said rigid bar first end include an end plate and a lanyard.

16. The post pulling device of claim 15, wherein:

said end plate is curved away from said rigid bar second end;

said end plate includes a plurality of spikes extending away from said rigid bar second end;

said end plate is pivotable toward said rigid bar first side and said rigid bar second side; and a pin selectively couples said end plate to said rigid bar.

* * * * *